US006426049B1

(12) United States Patent
Rosen et al.

(10) Patent No.: US 6,426,049 B1
(45) Date of Patent: Jul. 30, 2002

(54) COLLECTION ASSEMBLY

(75) Inventors: Steven M. Rosen, Mountain Lakes; Allison Peckham, Wayne; Alois Prais, Rutherford, all of NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/392,469

(22) Filed: Sep. 9, 1999

Related U.S. Application Data

(60) Provisional application No. 60/143,194, filed on Jul. 7, 1999.

(51) Int. Cl.[7] ..... B01L 3/14; B65D 41/50

(52) U.S. Cl. ..... 422/102; 422/99; 215/247; 215/320; 215/321; 215/355

(58) Field of Search ..... 422/99, 102; 600/573, 600/577; 215/211, 214, 216, 217, 224, 223, 228, 247, 320, 321, 353, 354, 355, 318; 220/301, 302

(56) References Cited

U.S. PATENT DOCUMENTS

| | | | | |
|---|---|---|---|---|
| 3,978,859 A | | 9/1976 | Goodenough et al. | |
| 4,136,794 A | * | 1/1979 | Percarpio | 215/247 |
| 4,187,952 A | * | 2/1980 | Percarpio | 215/247 |
| 4,542,833 A | | 9/1985 | DeVaughn | |
| 4,632,673 A | | 12/1986 | Tiitola et al. | |
| 5,224,515 A | | 7/1993 | Foster et al. | |
| 5,232,111 A | * | 8/1993 | Burns | 215/320 |
| 5,288,466 A | | 2/1994 | Burns | |
| 5,384,096 A | | 1/1995 | Burns | |
| D357,985 S | | 5/1995 | Burns | |
| 5,458,854 A | | 10/1995 | Burns | |
| 5,494,170 A | * | 2/1996 | Burns | 215/247 |
| 5,632,396 A | * | 5/1997 | Burns | 215/247 |
| 5,738,233 A | * | 4/1998 | Burns | 215/247 |

FOREIGN PATENT DOCUMENTS

| | | |
|---|---|---|
| EP | 0903107 A1 | 3/1999 |
| JP | 10-201742 | 8/1998 |

* cited by examiner

*Primary Examiner*—John Kim
(74) *Attorney, Agent, or Firm*—Nanette S. Thomas

(57) ABSTRACT

The present invention is a collection assembly comprising a container, a cap assembly removably and sealably secured to the container, whereby access to the interior of the container can be made with a piercing element without removing the cap assembly from the container. The cap assembly includes a cap body and a membrane like septum supported by the cap body. The septum provides for a pierceable element to have access to the interior of the container. The membrane is a thermoplastic elastomer and is self-sealing upon removal of the piercing element.

1 Claim, 5 Drawing Sheets

COLLECTION ASSEMBLY

This application claims the benefit under Title 35 USC 119(e) of U.S. provisional patent application No. 60/143,194, filed on Jul. 7, 1999.

BACKGROUND OF THE INVENTION

1. Field of the Invention

This invention relates to a collection assembly and more particularly to a microcollection container and cap suitable for collecting small quantities of a specimen such as blood from a patient and providing access to the interior of the container without the need for removing the cap from the assembly and for maintaining a specimen in secure fashion for subsequent testing.

2. Description of Related Art

Analytical instrumentation has made it possible to carry out a variety of hematological diagnostic procedures on very small quantities of blood. Because of this, a patient's finger or earlobe, for example, may be punctured and a very small quantity of blood may be rapidly collected into a container for such testing. Once the small quantities of blood are collected, the container is sealably covered by a cap.

In order for a laboratory technician to conduct tests on the blood sample which is collected in the container, the cap must be removed from the container so as to provide access to the blood sample. In the alternative, the entire contents of the container may be transferred from the container to an instrument compatible sample holder in order for laboratory analysis to take place.

Therefore, there is a need for a microcollection container that is (i) compatible with instruments for laboratory analysis whereby the specimen does not have to be transferred out of the container for analysis to be conducted; (ii) provides a resealable portion for easy access into the container by a needle or probe that also prevents specimen leakage out of the container, (iii) maintains a specimen in secure fashion; and (iv) prevents contamination to the specimen and to the user.

SUMMARY OF THE INVENTION

The present invention is a collection assembly comprising a container and a cap. The cap preferably comprises a top portion, a bottom portion, and an annular skirt extending from the top portion to the bottom portion having an inner surface and an outer surface. The cap further includes an inner inverted skirt portion surrounded by the inner surface of the annular skirt. Most preferably the inner inverted skirt portion is separated from the inner surface of the annular skirt by an annular space. The inner inverted skirt extends between an upper extent and a lower extent whereby the lower extent supports a septum or membrane. Desirably, the septum is a disc-like membrane formed of a self-sealing and resealing thermoplastic elastomer material.

Most preferably, the septum is capable of being pierced and resealed on a repetitive basis with a piercing element such as a needle or instrument probe. Most preferably, the septum is formed of a thermoplastic elastomer. Such thermoplastic elastomer includes isoprene propylene, such as MONOPRENE (a trademark of QST, Inc.) sold by QST, Inc., St. Albans, Vt.

Preferably, the membrane and the cap body may be co-injection molded or insert molded.

Most preferably, the cap also includes a cam follower positioned on the bottom portion. Desirably, the inside surface of the annular skirt comprises at least one protrusion and the inner inverted skirt portion has a sealing ring. The cap further comprises a rim extending from the outer surface of the annular skirt.

The container preferably comprises an open top portion, a closed bottom portion, a sidewall extending from the top portion to the bottom portion and an open end associated with the top portion having an integral collector. Most preferably, the integral collector is a scoop that is the same diameter as the inner diameter of the container so that no air vent is required.

Preferably, at least one lug is located on the outer diameter of the top portion of the container.

Preferably, the container further includes a cap seating flange associated with the outer diameter of the top portion of the container and an extending annular skirt associated with the bottom portion. Optionally, a reservoir is positioned within the cap seating flange and at least one lug is located in the reservoir. Preferably, the container also includes a locking ring associated between the integral collector and the cap seating flange.

Preferably, the collection assembly includes means for securing the inner surfaces of the cap to the top portion of the container by the interaction of the protrusions of the cap with the locking ring of the container and the sealing ring of the cap with the inside surface of the top portion of the container. Most preferably, the collection assembly also includes means for unsecuring the cap from the container by a cam arrangement on the cap and container. This cam arrangement assists in substantially reducing fluid splatter from the container when the cap is removed from the container.

In one embodiment of the invention, the cam arrangement includes at least one cam follower positioned on the bottom portion of the cap and at least one cam surface positioned on the outer diameter of the top portion of the container. A downwardly rotational force applied to the cap and an upwardly force applied to the container along the longitudinal axis, causes the cam follower and the cam surface to align and the cap to snap-seal to the container by the interaction of the protrusions of the cap with the locking ring of the container and the sealing ring of the cap with the inside surface of the top portion of the container. This action, which may cause an audible-snap, in turn seals the container by compressing the protrusions of the cap against the locking ring of the container and the sealing ring of the cap against the inside surface of the top portion of the container to form a non-permanent lock and to substantially prevent the outer surface of the top portion of the container from making contacting with the inside surface of the cap's annular skirt.

The cap and container are then unsecured in a twist off manner by applying a rotational force to the cap. Most preferably, an upward rotational force is applied to the cap and a downwardly force applied to the container along the longitudinal axis. This causes the cam follower to rise on the cam surface and in turn the cap is unsecured from the container. An important advantage of the present invention is that the rotational force applied to the cap can be bi-directional, that is clockwise or counter-clockwise.

In another embodiment of the invention, the cam arrangement includes at least one cam follower positioned on the bottom portion of the cap and at least one cam surface positioned in the cap seating flange of the container.

The collection assembly of the present invention is preferably used in micro-centrifuges. However, an extension may be secured and unsecured to the bottom portion of the container. The extension increases the length dimension of the container. With the extension, the container may be compatible with standard clinical centrifuges.

An advantage of the present invention is that any excess fluid on the outside surface of the integral collector is directed downwardly into the cap seating flange. Therefore, radial spray of excess fluid is minimized.

Another advantage of the invention is that the cap may be secured and unsecured to the bottom portion of the container. In particular, the annular space in the cap between the annular skirt and inverted skirt allows the cap to be removably secured with the bottom portion of the container by receiving the annular skirt of the container.

Still another advantage of the invention is that the recessed inverted skirt and the sealing-ring substantially reduces cap contact with fluid collected in the container. Therefore the inner surfaces of the cap may be minimally exposed to fluid collected in the container when the cap is secured to the top portion of the container.

Another advantage of the present invention is that the outer surface of the cap may preferably be configured to substantially limit movement or rolling of the cap or the assembly. This applies whether the cap is positioned with the top portion or bottom portion of the container.

Still another advantage of the present invention is that when the cap is secured to the container, the rim of the cap substantially prevents contamination to the specimen inside the container.

An advantage of the present invention is that it facilitates direct access to a sample or diagnostic instrumentation systems and enables microcollection tube compatibility with diagnostic instrumentation by providing features such as pierceability and self-resealing of the cap.

Still another advantage of the present invention is that the self-sealing pierceable cap permits mixing of the specimen in the container without transferring the specimen to another container and providing for direct access to the specimen via the self-sealing pierceable cap by diagnostic instrumentation.

Most notably, is that the present invention permits a specimen to be accessed through the top of the cap without removing the cap from the container, thereby providing minimal exposure of the specimen to the user.

In addition, the present invention permits the assembly to be directly used on instrumentation similar to that used for evacuated collection assemblies.

Advantages of the membrane of the present invention include that: (i) it can be pierced and resealed many times; (ii) it requires less than 2 lb. Force for a piercing element to pierce it; and (iii) the concave shape aids in the ability of the membrane to seal properly after the piercing element is removed.

DETAILED DESCRIPTION

Figure 1:
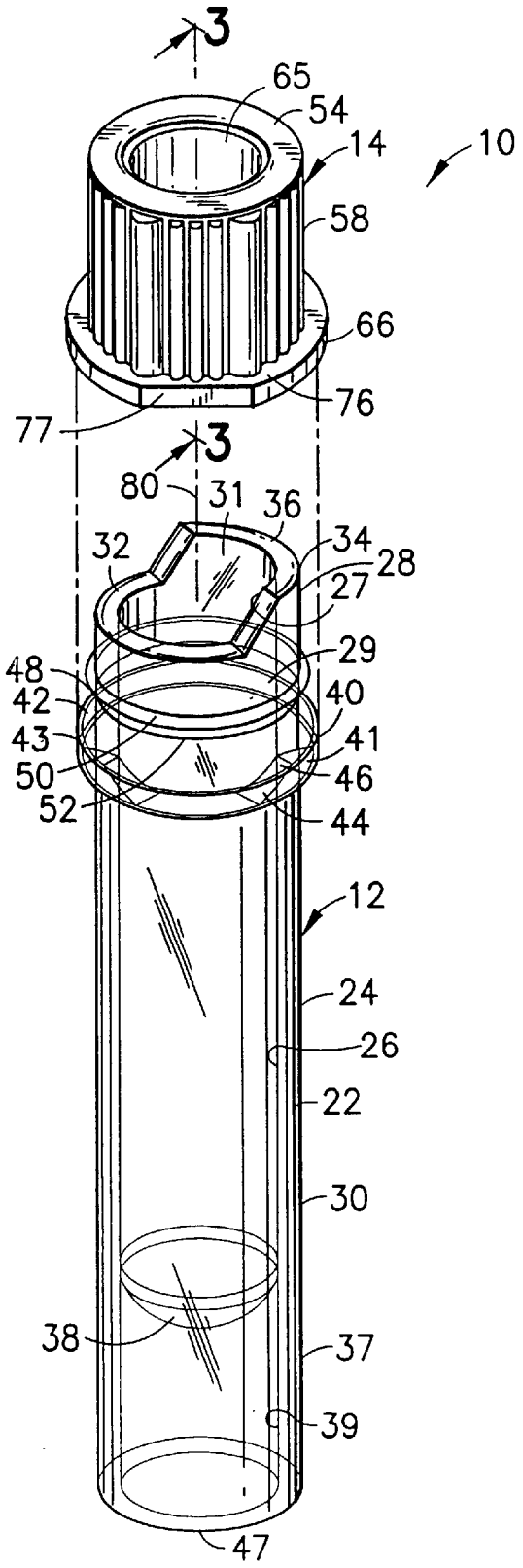
FIG. 1 is a perspective view of the collection assembly of the present invention illustrating the container, the cap and the septum.

Referring to the drawings in which like reference characters refer to like parts throughout the several views thereof, FIG. 1 illustrates a collection assembly 10 comprising a container 12 and a cap 14.

As illustrated in FIG. 1, container 12 has a sidewall 22 having an outer surface 24 and an inner surface 26. The sidewall extends from an upper portion 28 to a lower portion 30. Upper portion 28 includes an open end 31, an inner surface 27, an outer surface 29 and a top surface 32 having an integral lip portion 34 with a receiving edge 36. Lower portion 30 comprises a closed bottom end 38 and an annular skirt 37 extending from the closed bottom end and outer surface 24 to a bottom edge 47 so as to define a compartment area 39. Annular skirt 37 provides a means for allowing the container to be placed upright on a flat surface.

Upper portion 28 has a cap seating flange 40 positioned around the outer surface of the container which defines a well or trough 42 and an outer surface 41. The cap seating flange has an upper surface edge 43 and a plurality of lugs 44 each having a cam surface 46 in trough 42. Although a container having only one projecting lug is within the purview of the instant invention, a plurality of lugs is preferred. Also, although other shapes and configurations are within the purview of the instant invention, lugs 44 of this embodiment are triangularly shaped.

Figure 2:
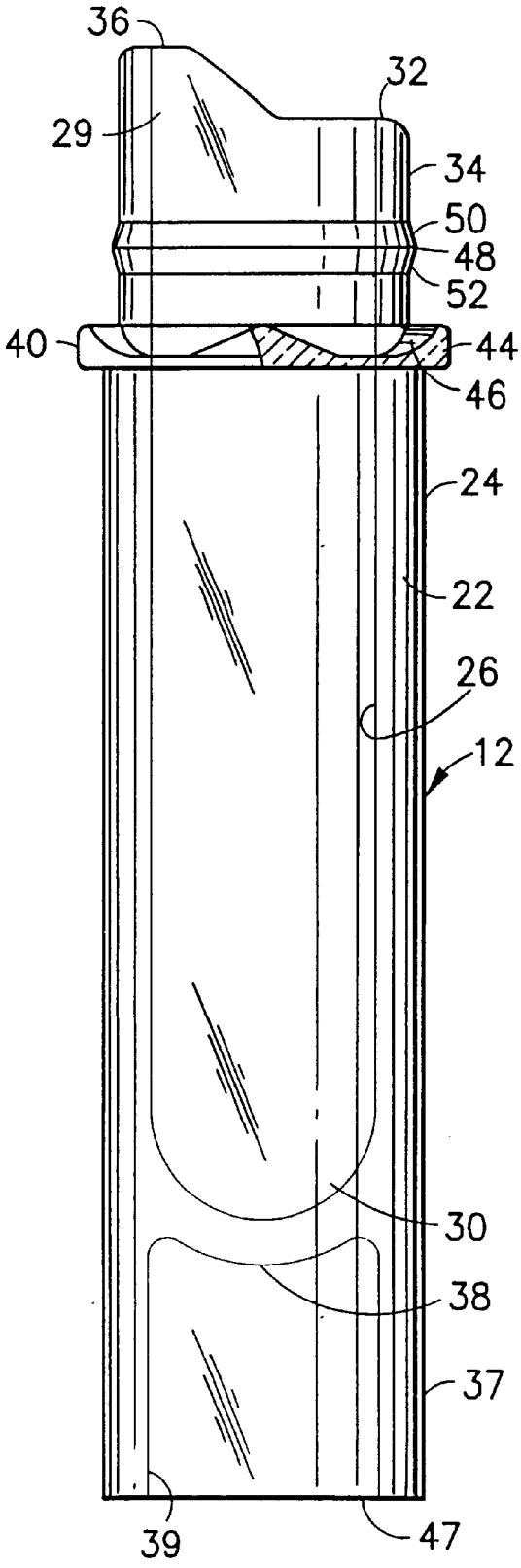
FIG. 2 is a side elevational view of the container of FIG. 1, partially in section of the cam surface area.

As shown in FIG. 2, further positioned on the outer surface of the container on the upper portion is a locking ring 48 positioned between receiving edge 36 of integral lip portion 34 and cap seating flange 40. The locking ring has an upper edge 50 and a lower edge 52.

Figure 3:
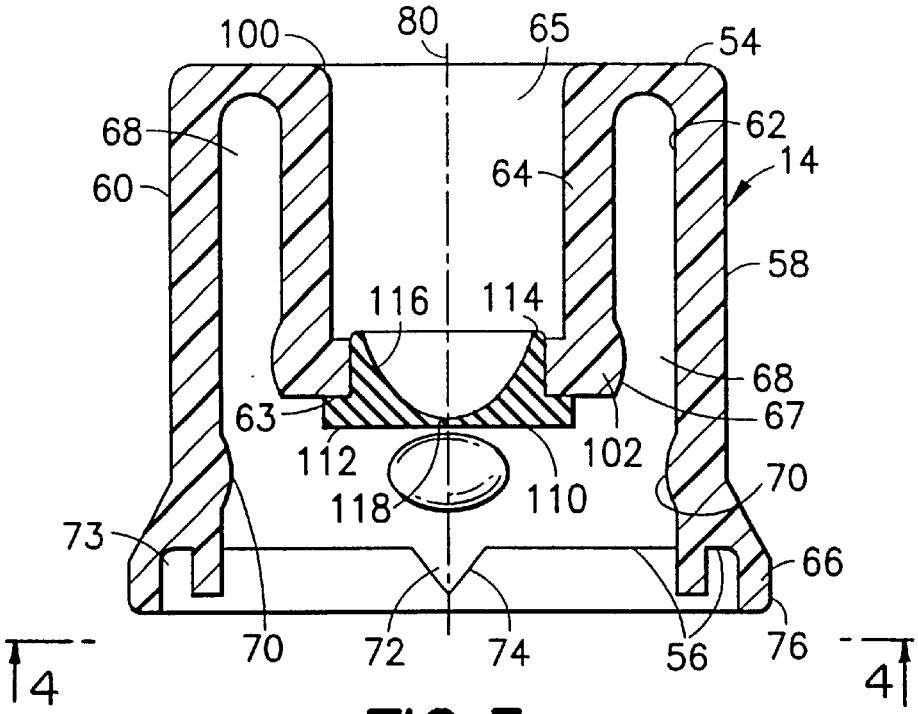
FIG. 3 is an enlarged cross sectional view of the cap of FIG. 1, taken along line 3—3 thereof.

Cap 14 as shown in FIG. 3, has a top surface 54, a bottom stop ledge 56 and an annular outer skirt 58 extending from the top surface to the bottom stop ledge. The annular outer skirt has an outer wall surface 60 and an inner wall surface 62. A shield 66 extends from the outer wall surface of the annular outer skirt and has an outer surface or circumference 76.

As shown in FIG. 3, cap 14 also has an inner annular inverted recessed skirt portion 64 that extends from top portion 54 to a bottom surface 63. The inverted recessed skirt portion includes an open upper extent 100, an opposed open lower extent 102 and a central passageway 65 therebetween which provides access through the cap and into the container.

The inner wall surface of the annular outer skirt and the inner annular inverted recessed skirt are spaced from each other to define an annular space 68. The cap further includes, a plurality of circumferentially spaced protrusions 70 positioned on inner wall surface 62 and a sealing ring 67 positioned on inverted recessed skirt portion 64. Projecting lugs 72 are located on bottom stop ledge 56 wherein each lug comprises a cam follower surface 74. A second annular space 73 is between shield 66 and projecting lugs 72.

Although a cap having only one projecting lug is within the purview of the instant invention, a plurality of lugs is preferred. Also, although other shapes and configurations are within the purview of the instant invention, lugs 72 of this embodiment are triangularly shaped.

Figure 4:
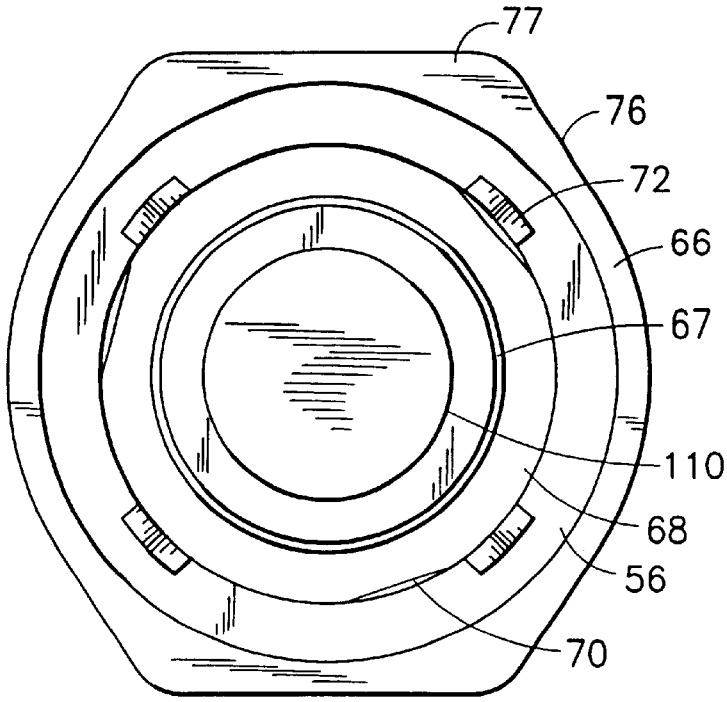
FIG. 4 is a bottom view of the cap of FIG. 1.

As shown in FIG. 4, flats 77 are positioned on the outer surface of shield 66. The flats substantially prevent the cap from rolling and provide a convenient grasping surface for ready removal and placement of the cap on the container. Although a shield with a smooth outer circumference without flats is within the purview of the instant invention, a shield with an outer surface with flats is preferred.

Figure 5:
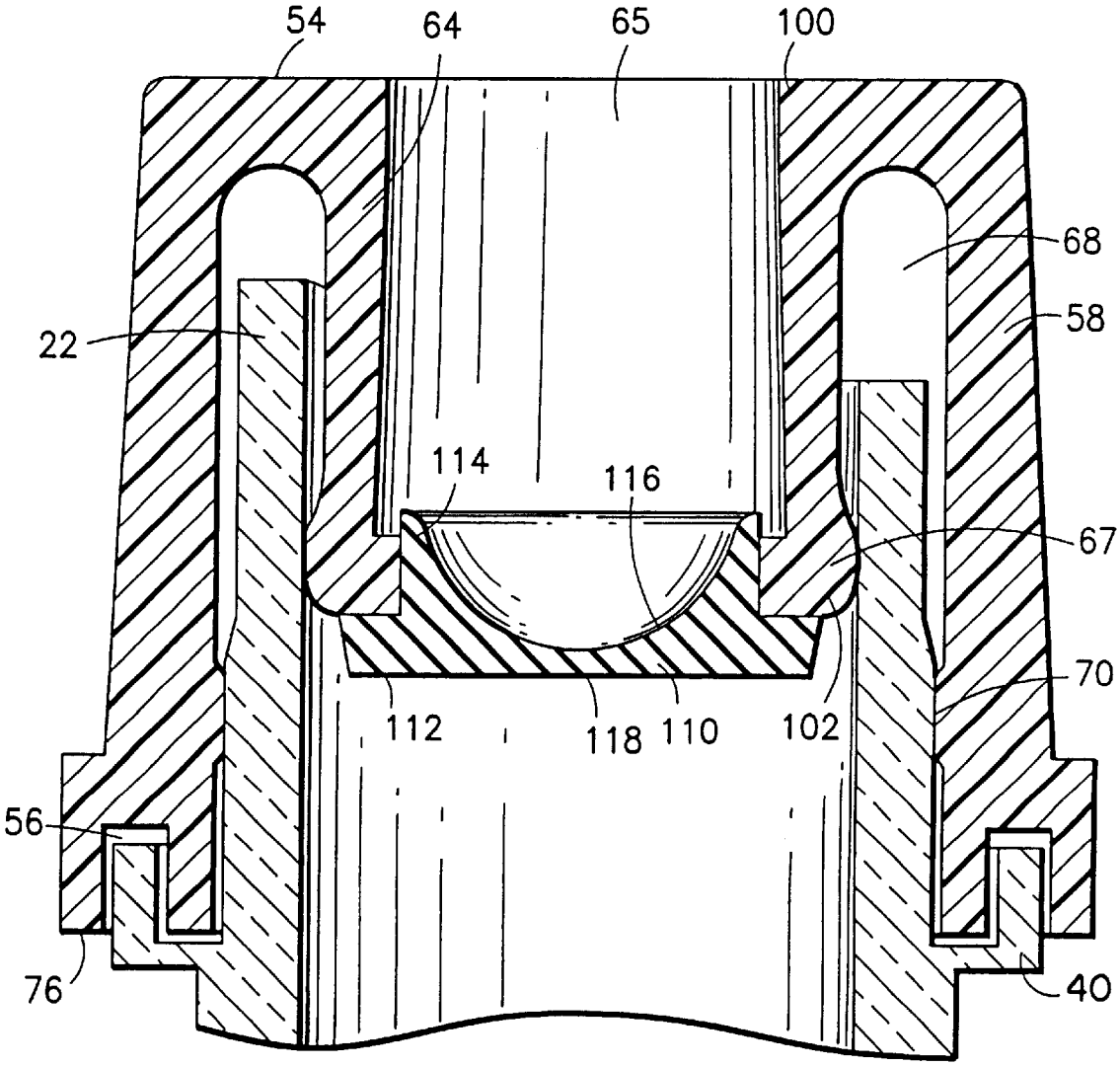
FIG. 5 is a side elevational view, partially in section of the collection assembly of FIG. 3.

As shown in FIG. 5, cap 14 further supports a septum 110 at lower extent 102 of annular skirt 64. Septum 110 is a disc-like membrane formed of a thermoplastic elastomer.

As shown in FIG. 5, septum 110 includes a planar portion 112 and an upwardly extending annular ridge 114. Annular ridge 114 has a diameter which allows it to be force fitted within open lower extent 102 of annular skirt 64. Planar portion 112 faces towards the interior of the container. Annular ridge 114 defines a concave surface 116 in opposition to planar portion 112. Septum 110 defines a centrally located portion 118 having a thickness of about 0.028 inches. Portion 112 allows the septum to be easily pierced by a cannula or probe that is used to extract a liquid sample from the interior of the container with only about 2 pounds of force.

When cap 14 is removably secured to container 12, space 68 of the cap receives the top portion of the container including the integral lip, wherein the outer protrusions 70 bear against lower edge 52 of locking ring 48 of the container, sealing ring 67 bears against inner surface 27 of the container and cam follower 74 contacts cam surface 46. Shield 66 extends around and not beyond outer surface 41 of cap seating flange 40 and bottom stop ledge 56 abuts with upper surface edge 43 of the cap seating flange 40, so as to form a non-permanent lock and substantially prevent any excess fluid in well 42 of the cap seating flange from spilling out. Any fluid between upper surface edge 43 and bottom stop ledge 56 is substantially directed by shield 66 in a downward direction along the container. Further, any fluid in well 42 is substantially contained by the upper surface edge of the cap seating flange and the bottom stop ledge of the cap.

Cam follower surface 74 and cam surface 46 are configured so that a downwardly rotational force applied to cap 14 about longitudinal axis 80 causes cam follower 74 to contact cam surface 46. Cap 14 is snapped onto the top portion of the container as guided by cam follower surface 74 and cam surface 46. Cap 14 is removably secured to container 12 by protrusions 70 and sealing ring 67 as they bear respectfully against lower edge 52 of the locking ring and inner surface 27 of the container. The position of the protrusions and sealing ring of the cap with the container forms space 69 between outer surface 29 of the top portion of the container and inner wall surface 62 of the cap's annular outer skirt. Therefore, wiping down of any fluid on the container's outer surface is substantially prevented.

In use, a liquid sample is collected in container 12 and then the cap is securely secured to the open end of the container.

Figure 6:
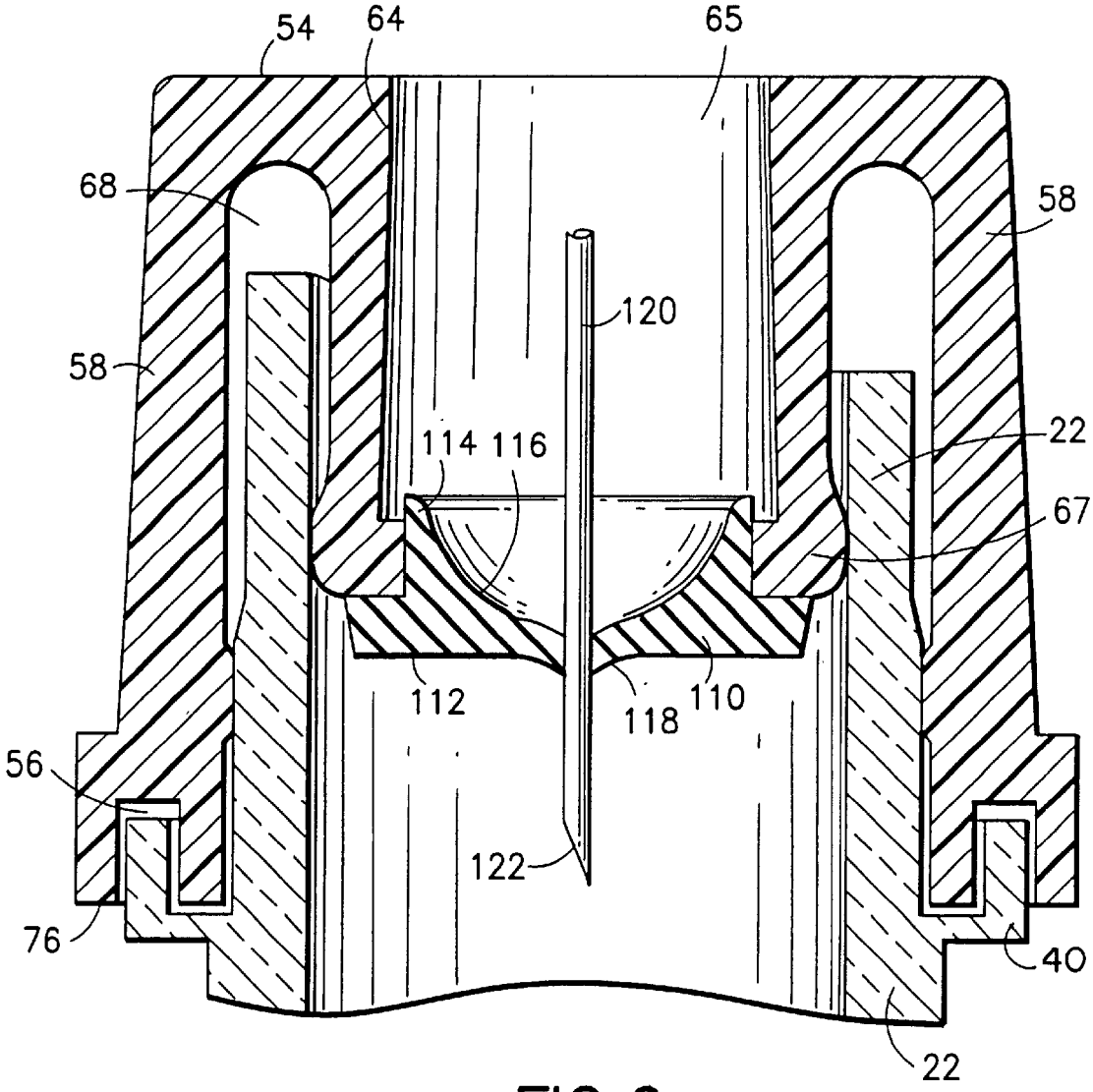
FIG. 6 illustrates the collection assembly of FIG. 5, with a probe extending thereinto.

As shown in FIG. 6, a sample probe or cannula 120 may be inserted into container 12 by inserting cannula 120 through passageway 65. The distal tip 122 of cannula 120 may then pierce through septum 110 at portion 118. Since the material of septum 110 is a thermoplastic elastomer, septum 110 is easily pierced by low insertion forces. Therefore, for a relatively wide instrument probe having a diameter of about 0.0625 inches, portion 118 of septum 110 may be pierced by a force of less than 2 pounds.

Insertion of cannula 120 continues until it reaches the sample in the interior of the container and then collects a portion of the sample. Cannula 120 is then removed by withdrawing it back through passageway 65. Upon withdrawing cannula 120 from septum 110, the thermoplastic elastomer septum self-seals. In addition, concave surface 112 facing in opposition thereto helps reseal a hole placed in septum 110 by cannula 120. The septum shape defines a concave surface in the direction of cannula withdrawal. The compressive forces exerted by such a shape have a tendency to effect resealing of any hole placed therein as cannula 120 is withdrawan from the container. Thus, the particular configuration of septum 110 as well as the material from which it is formed permits the septum to reseal after multiple puncture sites have been placed therein. The liquid sample in the container can therefore be repeatedly sampled with the septum self-sealing upon each sample extraction.

The collection assembly of the invention may be made of a clear molded thermoplastic material so that the specimen collected may be readily viewed. Representative materials include, for example, polyethylene, polypropylene and polyvinyl chloride. The collection container may incorporate a hydrophilic material or a silicon may be applied to the internal surface thereof for enhancing the flow of blood introduced into the container.

Although is within the purview of the invention to provide caps which are colored to define specific forms of fluid collection containers containing materials for one reason or another or for defining the kind of examination to be conducted on the specimen collected, transparent caps may be provided. Also, it should be noted that the dimensions of the container are such as to provide space for labeling which may be important for identifying the collected specimens.

What is claimed is:

1. A collection assembly comprising:

a cap comprising a longitudinal axis, a top portion, a bottom portion, an annular skirt extending from said top portion to said bottom portion and having an inner surface and an outer surface, an inner inverted skirt portion extending from an upper extent to a lower extent and surrounded by said inner surface of said annular skirt and extending from said top portion toward said bottom portion, a passageway in said inverted skirt portion, a disc-like isoprene propylene septum supported by said lower extent of said annual skirt and co-injection molded with said cap, an annular space between said inner surface of said annular skirt and said inverted skirt portion, a cam follower extending from said bottom portion of said annular skirt, at least one protrusion positioned on said inner surface of said annular skirt, a sealing ring on said inner inverted skirt portion, and a rim extending from said outer surface of said annular skirt and facing said cam follower wherein a second annular space is provided between said rim and said cam follower; and a container comprising an open top portion, a closed bottom portion, a sidewall extending from said top portion to said bottom portion and having an inner and an outer surface, an integral collector extending from said top portion, a cap seating flange associated with said outer surface of said sidewall, a reservoir positioned within said cap seating flange and at least one lug having a cam surface positioned within said reservoir and a locking ring on said outer surface of said container positioned between said integral collector and said cap seating flange;

wherein said protrusion bears against said locking ring of said container, said sealing ring bears against said inner surface of said top portion of said container and said rim extending around and less than flush with said cap seating flange when said cap is placed over said open top portion of said container.

* * * * *